US010586650B2

(12) United States Patent
Taniguchi

(10) Patent No.: US 10,586,650 B2
(45) Date of Patent: Mar. 10, 2020

(54) COIL SUBSTRATE AND METHOD FOR MANUFACTURING THE SAME

(71) Applicant: IBIDEN CO., LTD., Ogaki (JP)

(72) Inventor: Hirotaka Taniguchi, Ogaki (JP)

(73) Assignee: IBIDEN CO., LTD., Ogaki (JP)

( * ) Notice: Subject to any disclaimer, the term of this patent is extended or adjusted under 35 U.S.C. 154(b) by 0 days.

(21) Appl. No.: 15/659,866

(22) Filed: Jul. 26, 2017

(65) Prior Publication Data

US 2018/0033549 A1 Feb. 1, 2018

(30) Foreign Application Priority Data

Jul. 26, 2016 (JP) ..... 2016-145926

(51) Int. Cl.

| | |
|---|---|
| ***H01F 5/00*** | (2006.01) |
| ***H01F 41/04*** | (2006.01) |
| ***H01F 41/12*** | (2006.01) |
| ***H01F 17/00*** | (2006.01) |

(52) U.S. Cl.

CPC ..... *H01F 41/043* (2013.01); *H01F 17/0013* (2013.01); *H01F 41/041* (2013.01); *H01F 41/125* (2013.01); *H01F 2017/002* (2013.01); *Y10T 29/49073* (2015.01)

(58) Field of Classification Search

CPC ..... H01F 41/125; H01F 41/043

USPC ..... 336/200

See application file for complete search history.

(56) References Cited

U.S. PATENT DOCUMENTS

| | | | | |
|---|---|---|---|---|
| 8,110,749 | B2 * | 2/2012 | Yoshimura | H05K 3/445 174/260 |
| 8,151,456 | B2 * | 4/2012 | Maehara | H05K 1/115 174/255 |
| 8,278,214 | B2 * | 10/2012 | Roy | H01L 21/4857 257/E21.503 |
| 9,000,302 | B2 * | 4/2015 | Shimizu | H01L 23/5383 174/251 |
| 9,668,341 | B2 * | 5/2017 | Furuichi | H01L 23/49822 |
| 9,820,391 | B2 * | 11/2017 | Shimizu | H01L 24/13 |
| 2011/0057629 | A1 * | 3/2011 | Lin | H02K 3/26 322/3 |
| 2014/0124777 | A1 * | 5/2014 | Nakatani | H05K 3/4673 257/43 |
| 2014/0311771 | A1 * | 10/2014 | Shimizu | H01L 23/5383 174/251 |
| 2015/0156881 | A1 * | 6/2015 | Shimizu | H05K 3/30 174/255 |

(Continued)

FOREIGN PATENT DOCUMENTS

JP 2012-138495 A 7/2012

*Primary Examiner* — Ronald Hinson

(74) *Attorney, Agent, or Firm* — Oblon, McClelland, Maier & Neustadt, L.L.P.

(57) ABSTRACT

A coil substrate includes insulating layers, and conductive layers laminated on the insulating layers in a plate thickness direction of the insulating layers, respectively. The conductive layers include three or more conductive layers and a set of conductive layers such that the set of conductive layers includes a first outermost conductive layer on one end side in the plate thickness direction and does not include a second outermost conductive layer on the opposite end side in the plate thickness direction and that the set of conductive layers includes coil portions each having a spiral form respectively and aligned in the plate thickness direction.

15 Claims, 8 Drawing Sheets

(56) References Cited

U.S. PATENT DOCUMENTS

2015/0357277 A1* 12/2015 Nagai ..... H01L 23/49838
174/255
2016/0044789 A1* 2/2016 Shimizu ..... H05K 1/185
174/251
2016/0049237 A1* 2/2016 Yosui ..... H01F 17/0013
336/200

* cited by examiner

COIL SUBSTRATE AND METHOD FOR MANUFACTURING THE SAME

CROSS-REFERENCE TO RELATED APPLICATIONS

The present application is based upon and claims the benefit of priority to Japanese Patent Application No. 2016-145926, filed Jul. 26, 2016, the entire contents of which are incorporated herein by reference.

BACKGROUND OF THE INVENTION

Field of the Invention

The present invention relates to a coil substrate having multiple conductive layers laminated via insulating layers, and relates to a method for manufacturing the coil substrate.

Description of Background Art

A coil substrate may have a coil part provided in multiple conductive layers in a center portion in a plate thickness direction.

SUMMARY OF THE INVENTION

According to one aspect of the present invention, a coil substrate includes insulating layers, and conductive layers laminated on the insulating layers in a plate thickness direction of the insulating layers, respectively. The conductive layers include three or more conductive layers and a set of conductive layers such that the set of conductive layers includes a first outermost conductive layer on one end side in the plate thickness direction and does not include a second outermost conductive layer on the opposite end side in the plate thickness direction and that the set of conductive layers includes coil portions each having a spiral form respectively and aligned in the plate thickness direction.

According to another aspect of the present invention, a method for manufacturing a coil substrate includes laminating insulating layers and conductive layers in a plate thickness direction of the insulating layers respectively such that the laminating of the conductive layers includes laminating three or more conductive layers and forming a set of conductive layers such that the set of conductive layers includes a first outermost conductive layer on one end side in the plate thickness direction and does not include a second outermost conductive layer on the opposite end side in the plate thickness direction and that the set of conductive layers includes coil portions each having a spiral form respectively and aligned in the plate thickness direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
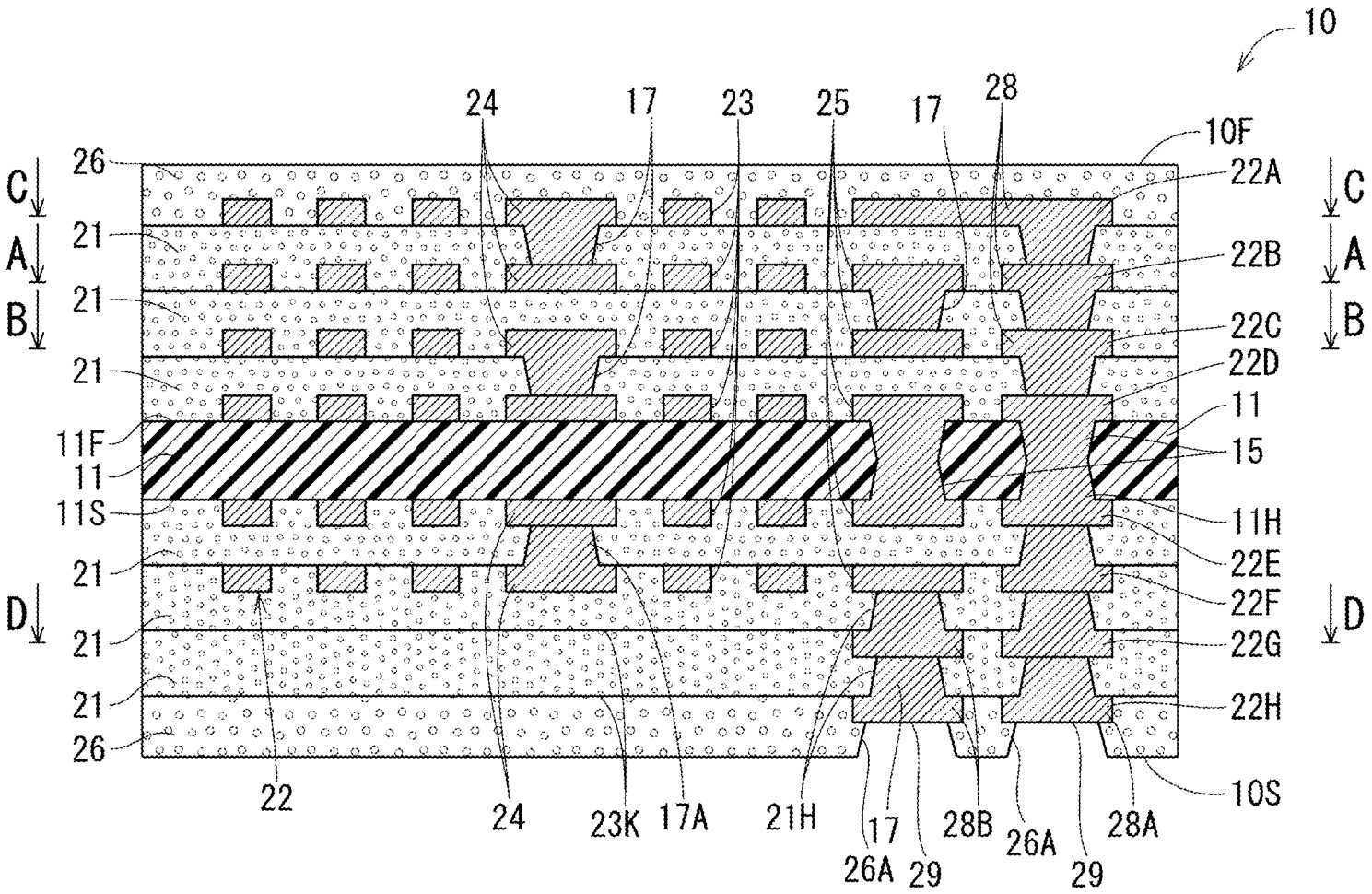
FIG. 1 is a cross-sectional side view of a coil substrate according to an embodiment of the present invention.

Embodiments will now be described with reference to the accompanying drawings, wherein like reference numerals designate corresponding or identical elements throughout the various drawings.

In the following, embodiments according to the present invention are described with reference to FIG. 1-8. As illustrated in FIG. 1, a coil substrate 10 of the present embodiment has a structure in which conductive layers 22 and interlayer insulating layers 21 are alternately laminated on both front and back sides of a core substrate 11, and solder resist layers (26, 26) are further respectively laminated on front and back surfaces. The number of the conductive layers 22 and the interlayer insulating layers 21 is the same on both sides of the core substrate 11.

In the following, a surface at one end in a plate thickness direction of the coil substrate 10 is referred to as a first surface (10F) and a surface at the other end is referred to as a second surface (10S). Further, a surface of the core substrate 11 on the first surface (10F) side is referred to as an F surface (11F), and a surface of the core substrate 11 on an opposite side of the F surface (11F) is referred to as an S surface (11S). Further, when the multiple conductive layers 22 are distinguished from each other, the multiple conductive layers 22 are respectively referred to as a first conductive layer (22A), a second conductive layer (22B), a third conductive layer (22C), . . . , and an eighth conductive layer (22H), in an order from the outermost conductive layer 22 on the first surface (10F) side to the outermost conductive layer 22 on the second surface (10S) side.

The core substrate 11 is a prepreg obtained by impregnating a woven fabric of reinforcing fibers (for example, a glass cloth) with a resin. The core substrate 11 has a thickness of, for example, about 50-70 μm. The interlayer insulating layers 21 and the solder resist layers 26 are each a resin layer that does not contain reinforcing fibers. Further, the interlayer insulating layers 21 each have a thickness of, for example, about 16-20 μm. A thickness of each of the solder resist layers 26 is larger than the thickness of each of the interlayer insulating layers 21, and is, for example, about 18-22 μm. Further, as will be described in detail later, the conductive layers 22 are each mainly formed of copper plating. A thickness of each of the conductive layers 22 is smaller than the thickness of each of the interlayer insulating layers 21 and is, for example, about 14-18 μm.

The first-sixth conductive layers (22A-22F) each have a coil part 23 (see FIG. 2A, FIG. 2B or FIG. 3A), and these coil parts 23 are aligned in the plate thickness direction of the coil substrate 10. Further, the remaining seventh and eighth conductive layers (22G, 22H) do not each have a coil part 23. Of each of the seventh and eighth conductive layers (22G, 22H), a portion overlapping with the coil parts 23 in a lamination direction is a blank part (23K) where a conductor does not exist (see FIG. 3B). Further, the coil parts (23, 23) are connected in series by via conductors 17 or connection conductors 15 (each of which corresponds to an "interlayer connection part" according to an embodiment of the present invention) that each penetrate an interlayer insulating layer 21 or the core substrate 11, and a pair of pads (29, 29), which respectively form both terminals of the series circuit, are provided on the second surface (10S) side of the coil substrate 10.

Figure 2A:
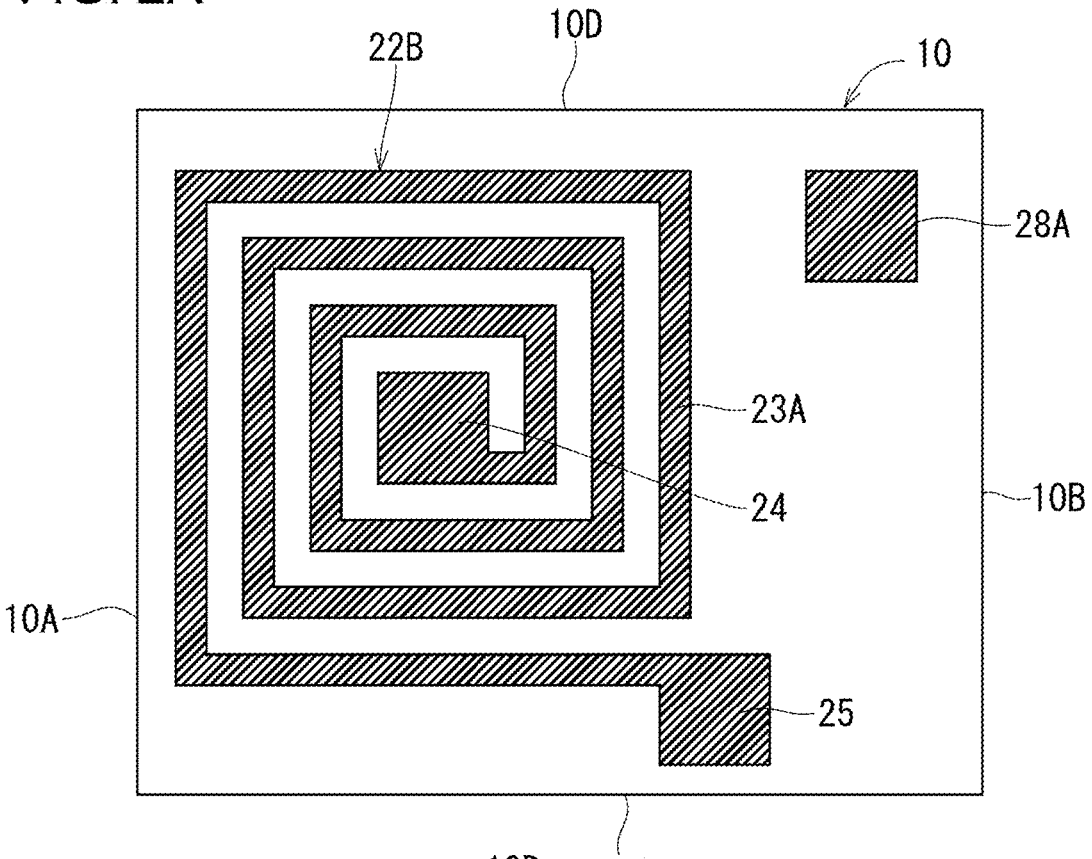
FIG. 2A is a cross-sectional plan view of a second conductive layer on an A-A cutting plane in FIG. 1.

Specifically, FIG. 2A illustrates a planar shape of the coil substrate 10 and a planar shape of the second conductive layer (22B) viewed from the first surface (10F) side. Further, of each of the fourth and sixth conductive layers (22D, 22F), a planar shape viewed from the first surface (10F) side is the same as that of the second conductive layer (22B). As illustrated in FIG. 2A, the planar shape of the coil substrate 10 is a laterally-long quadrangle. The second, fourth and sixth conductive layers (22B, 22D, 22F) each include a coil part 23 and a first land part (28A). The coil part 23 is formed by alternately connecting linear portions and bent portions, the linear portions extending from an outer end toward an inner end, and the bent portions each bending at a right angle to the right. That is, the coil part 23 has a substantially quadrangular shape as a whole, and has a so-called right-handed spiral shape.

Further, the inner end of the coil part 23 forms a quadrangular inner land part 24 having a side larger than a width of a middle linear portion of the coil part 23. The inner land part 24 is positioned at substantially a centroid of the quadrangular shape of the entire coil part 23, and is slightly shifted toward a side of a short side (10A) on one side from a centroid of the coil substrate 10. On the other hand, the outer end of the coil part 23 forms an outer land part 25 having substantially the same shape as that of the inner land part 24, and is positioned closer to a short side (10B) on the other side of the coil substrate 10 and is near a long side (10C) on one side. Further, the first land part (28A) has, for example, substantially the same quadrangular shape as that of the inner land part 24 and the outer land part 25, and is positioned near a corner between the short side (10B) on the other side and a long side (10D) on the other side of the coil substrate 10.

Figure 2B:
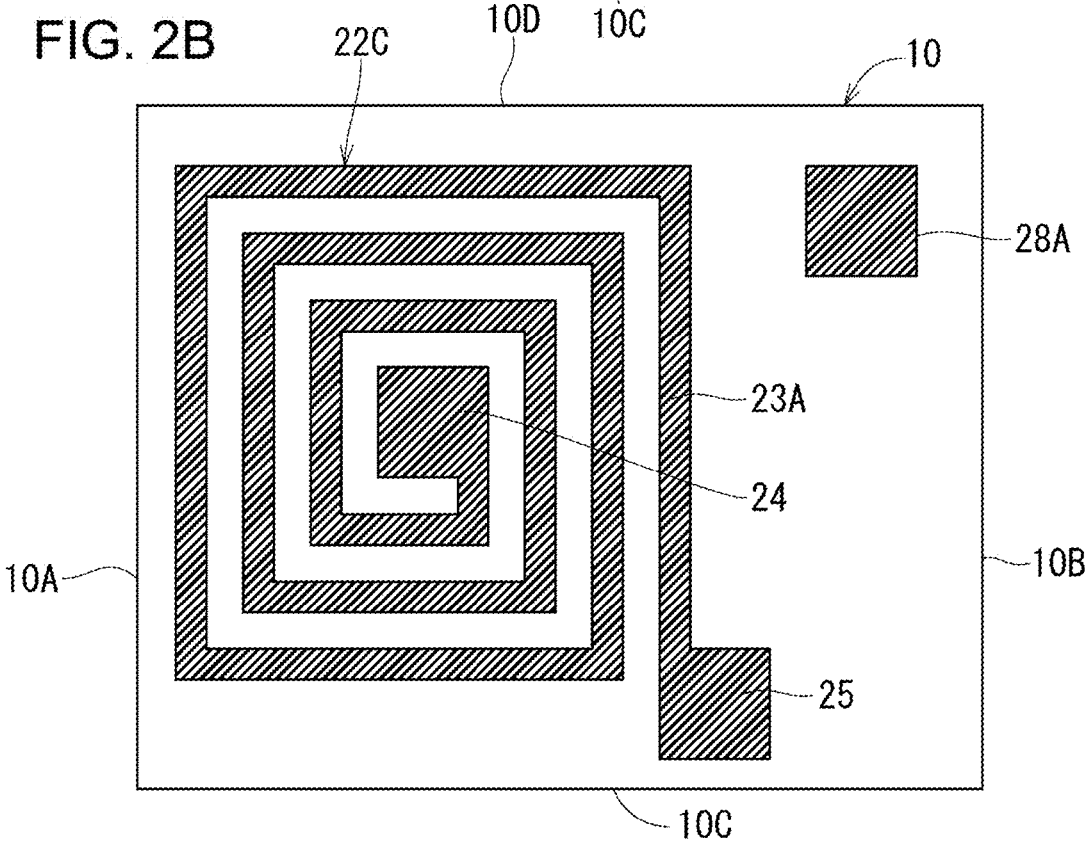
FIG. 2B is a cross-sectional plan view of a third conductive layer on a B-B cutting plane in FIG. 1.

FIG. 2B illustrates a planar shape of the third conductive layer (22C) viewed from the first surface (10F) side. Further, a planar shape of the fifth conductive layer (22E) viewed from the first surface (10F) side is the same as that of the third conductive layer (22C). The third and fifth conductive layers (22C, 22E) each include a coil part 23 and a first land part (28A), and each have the same structure as that of the second conductive layer (22B) except that the coil part 23 has a so-called left-handed spiral shape.

Figure 3A:
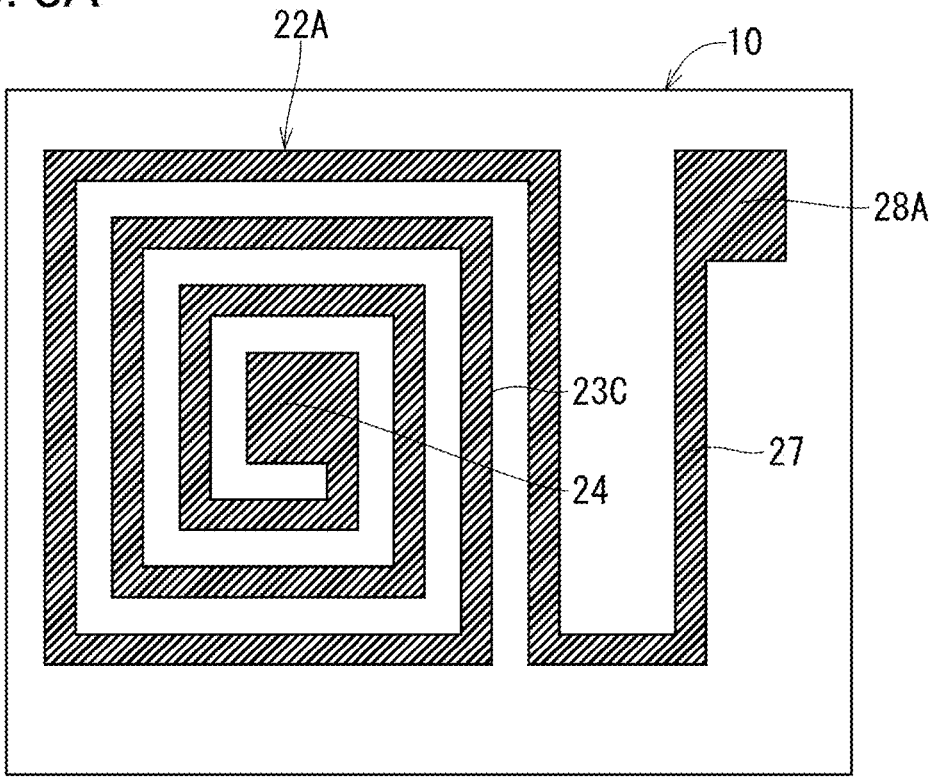
FIG. 3A is a cross-sectional plan view of a first conductive layer on a C-C cutting plane in FIG. 1.

FIG. 3A illustrates a planar shape of the first conductive layer (22A) viewed from the first surface (10F) side. The first conductive layer (22A) includes a coil part 23, a first land part (28A), and a relay part 27. The coil part 23 is the same as that of the third conductive layer (22C) except that an outer land part 25 is not provided at an outer end and that the relay part 27 is provided. The outer end of the coil part 23 and the first land part (28A) are connected by the relay part 27.

Figure 3B:
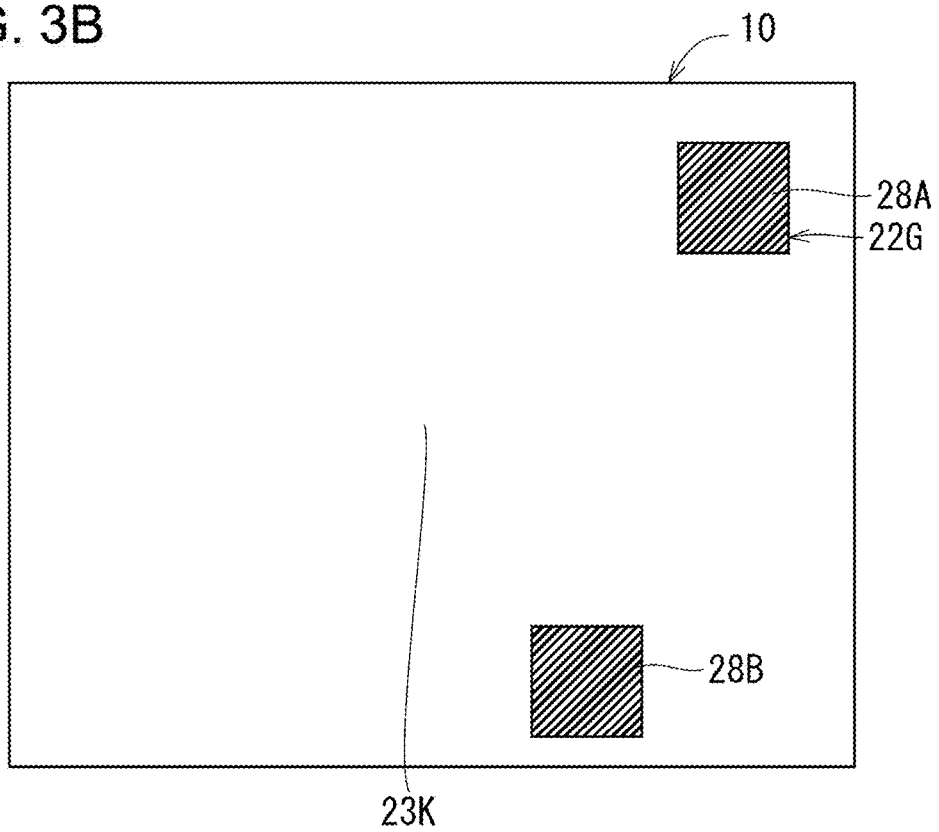
FIG. 3B is a cross-sectional plan view of a seventh conductive layer on a D-D cutting plane in FIG. 1.

FIG. 3B illustrates a planar shape of the seventh conductive layer (22G) viewed from the first surface (10F) side. Further, a planar shape of the eighth conductive layer (22H) viewed from the first surface (10F) side is the same as that of the seventh conductive layer (22G). The seventh and eighth conductive layers (22G, 22H) each include only a first land part (28A) and a second land part (28B). The first land part (28A) has the same shape and the same formation as the first land part (28A) of each of the second-sixth conductive layers 22. On the other hand, the second land part (28B) has the same shape and the same formation as the outer land part 25 of each of the second-sixth conductive layers (22B-22F).

The inner land parts 24 of the first-sixth conductive layers (22A-22F) are formed to overlap when viewed from the plate thickness direction of the coil substrate 10. The outer land parts 25 of the second-sixth conductive layers (22B-22F) and the second land parts (28B) of the seventh and eighth conductive layers (22G, 22H) are also formed to overlap when viewed from the plate thickness direction of the coil substrate 10. Further, the first land parts (28A) of the first-eighth conductive layers (22B-22H) are also formed to overlap when viewed from the plate thickness direction of the coil substrate 10.

Between the first and second conductive layers (22A, 22B), between the third and fourth conductive layers (22C, 22D), and between the fifth and sixth conductive layers (22E, 22F), the inner land parts (24, 24) are connected to each other by a via conductor 17 that penetrates the interlayer insulating layer 21. Further, between the second and third conductive layers (22B, 22C), and between the fourth and fifth conductive layers (22D, 22E), the outer land parts (25, 25) are connected to each other by a via conductor 17 or connection conductors 15 that each penetrate the interlayer insulating layer 21 or the core substrate 11. That is, the multiple coil parts 23 are connected by connecting, in the order of, from the first surface (10F) side, the inner ends, the outer ends, the inner ends, the outer ends, and the inner ends, and a series circuit of the multiple coil parts 23 is formed. As a result, when a current flows through the series circuit of the multiple coil parts 23, magnetic fluxes generated in the coil parts 23 are oriented in the same direction.

Further, the first land parts (28A) of the first-eighth conductive layers (22A-22H) are connected by the via conductors 17 or the connection conductors 15, and form an "extended connection part" according to an embodiment of the present invention. Further, the outer land part 25 of the sixth conductive layer (22F) and the second land parts (28B) of the seventh and eighth conductive layers (22G, 22H) are connected by the via conductors 17, and form an "extended connection part" according to an embodiment of the present invention. The first land part (28A) and the second land part (28B) of the eighth conductive layer (22H) are respectively exposed on deep sides of openings (26A, 26A) provided in the solder resist layer 26 on the second surface (10S) side of the coil substrate 10, and respectively form the pads (29, 29).

The coil substrate 10 of the present embodiment is manufactured as follows.

Figure 4A:
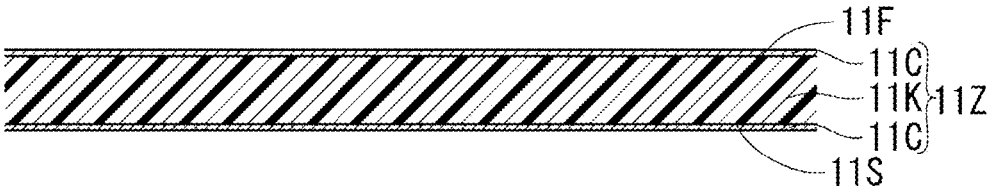
FIG. 4A-4D are cross-sectional side views illustrating manufacturing processes of the coil substrate.

(1) As illustrated in FIG. 4A, a copper-clad laminated plate (11Z) is prepared in which a copper foil (11C) is laminated on both front and back sides of an insulating base material (11K). The insulating base material (11K) is formed of an insulating base material, and is a prepreg obtained by impregnating a woven cloth (such as a glass cloth) formed of reinforcing fiber with an epoxy resin or a BT (bismaleimide triazine) resin.

Figure 4B:
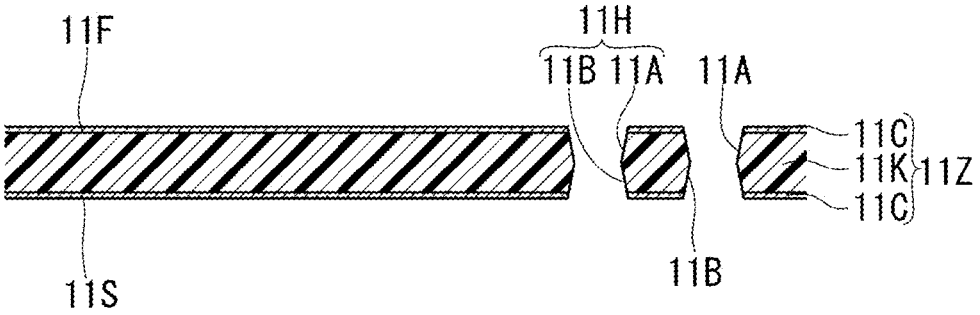

(2) As illustrated in FIG. 4B, through holes (11H) for forming the connection conductors 15 (see FIG. 1) are formed in the copper-clad laminated plate (11Z). Specifically, tapered holes (11A) are formed, for example, by irradiating CO2 laser from the F surface (11F) side of the copper-clad laminated plate (11Z). Next, tapered holes (11B)

are formed by irradiating CO2 laser to positions directly on back of the above-described tapered holes (11A) on the F surface (11F) side of the copper-clad laminated plate (11Z), and the through holes (11H) for the connection conductors 15 are each formed from a pair of tapered holes (11A, 11B).

Figure 4C:
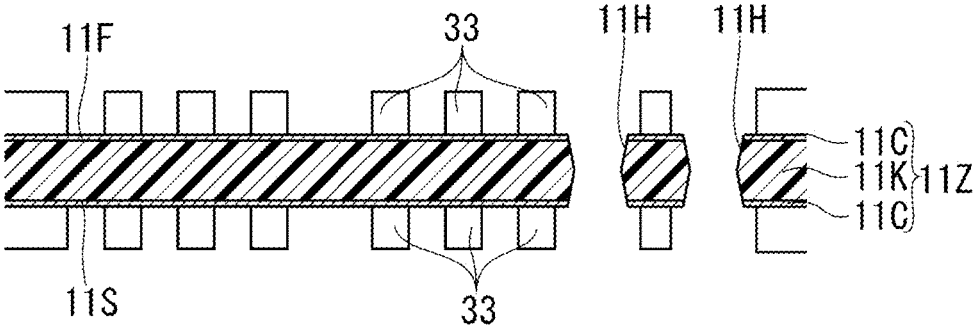

(3) An electroless plating treatment is performed. An electroless plating film (not illustrated in the drawings) is formed on the copper foil (11C) and on inner surfaces of the through holes (11H). Next, as illustrated in FIG. 4C, a plating resist 33 of a predetermined pattern is formed on the electroless plating film on the copper foil (11C).

Figure 4D:
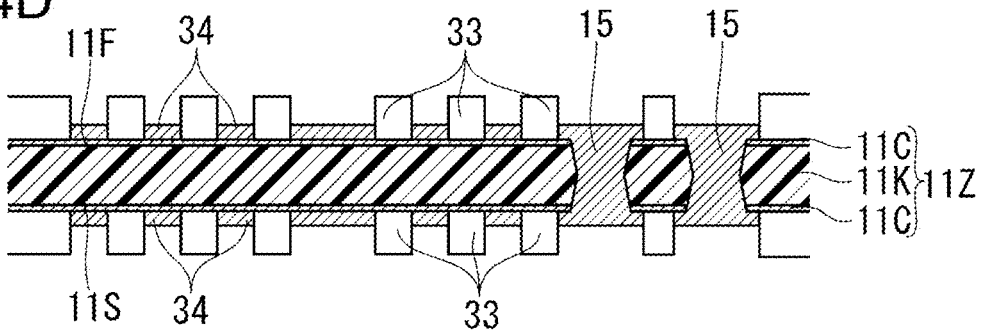

(4) As illustrated in FIG. 4D, an electrolytic plating treatment is performed. The through holes (11H) are filled with electrolytic plating and the connection conductors 15 are formed; and electrolytic plating films (34, 34) are formed on portions of the electroless plating film (not illustrated in the drawings) on the F surface (11F) and on the S surface (11S) of the copper-clad laminated plate (11Z), the portions being exposed from the plating resist 33.

Figure 5A:
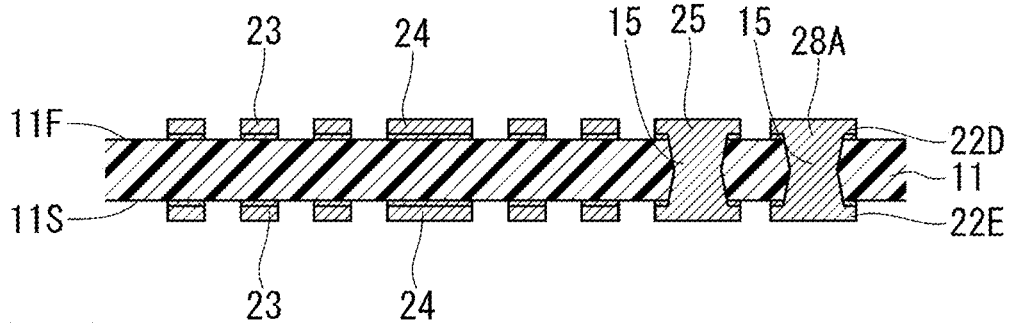
FIG. 5A-5D are cross-sectional side views illustrating manufacturing processes of the coil substrate.

(5) The plating resist 33 is peeled off, and the electroless plating film (not illustrated in the drawings) and the copper foil (11C), which are below the plating resist 33, are removed. As illustrated in FIG. 5A, the core substrate 11 is formed in which, by the remaining electrolytic plating film 34, electroless plating film and copper foil (11C), the fourth conductive layer (22D) is formed in the F surface (11F) of the insulating base material (11K) and the fifth conductive layer (22E) is formed on the S surface (11S) of the insulating base material (11K). Further, the fourth and fifth conductive layers (22D, 22E) are connected by the connection conductors 15.

Figure 5B:
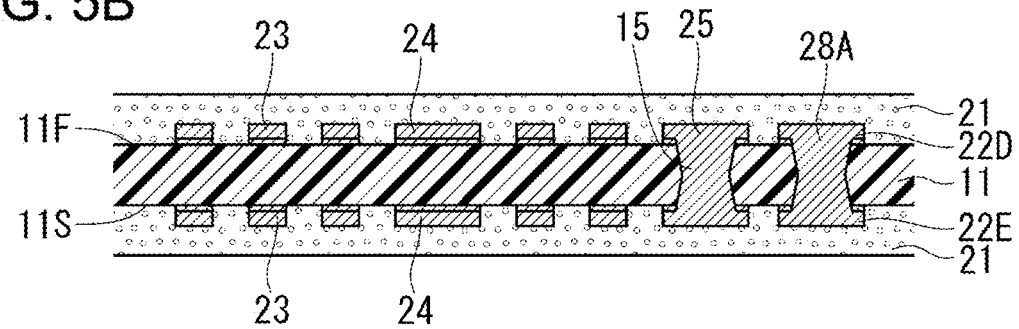

(6) As illustrated in FIG. 5B, the interlayer insulating layers (21, 21) are respectively laminated on the fourth conductive layer (22D) and the fifth conductive layer 22.

Figure 5C:
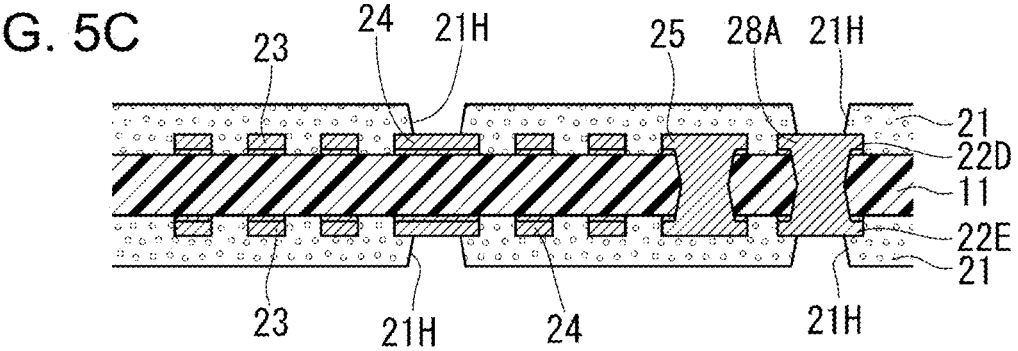

(7) As illustrated in FIG. 5C, by irradiating CO2 laser to the interlayer insulating layers (21, 21), tapered via holes (21H) penetrating the interlayer insulating layers 21 are formed.

Figure 5D:
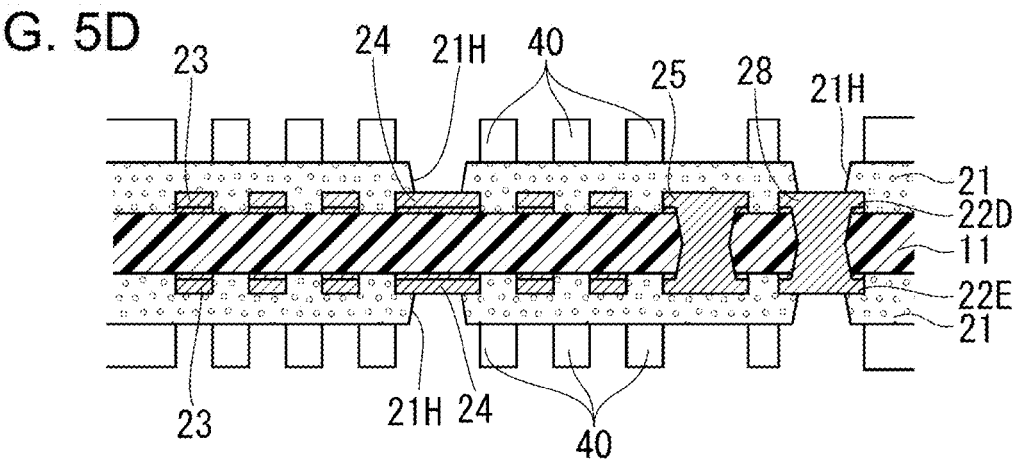

(8) An electroless plating treatment is performed. An electroless plating film (not illustrated in the drawings) is formed on the interlayer insulating layers (21, 21) and on inner surfaces of the via holes (21H). Next, as illustrated in FIG. 5D, a plating resist 40 of a predetermined pattern is formed on the electroless plating film on the interlayer insulating layers (21, 21).

Figure 6A:
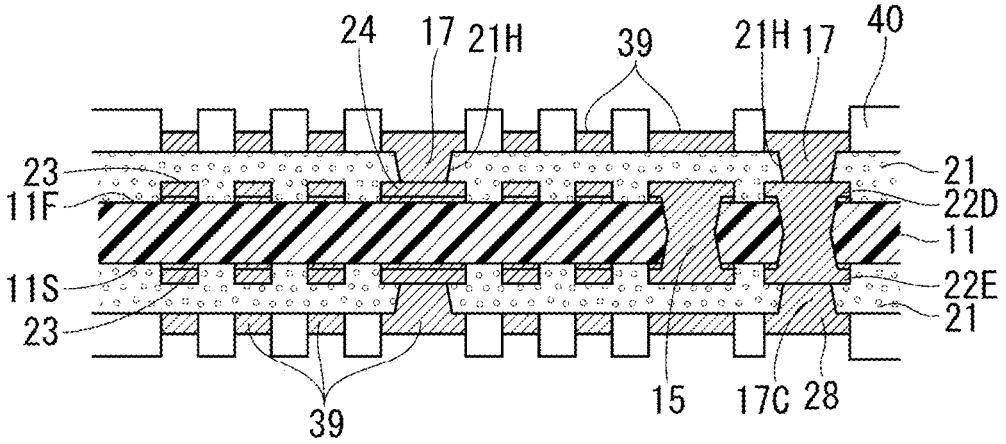
FIG. 6A-6C are cross-sectional side views illustrating manufacturing processes of the coil substrate.
Figure 6B:
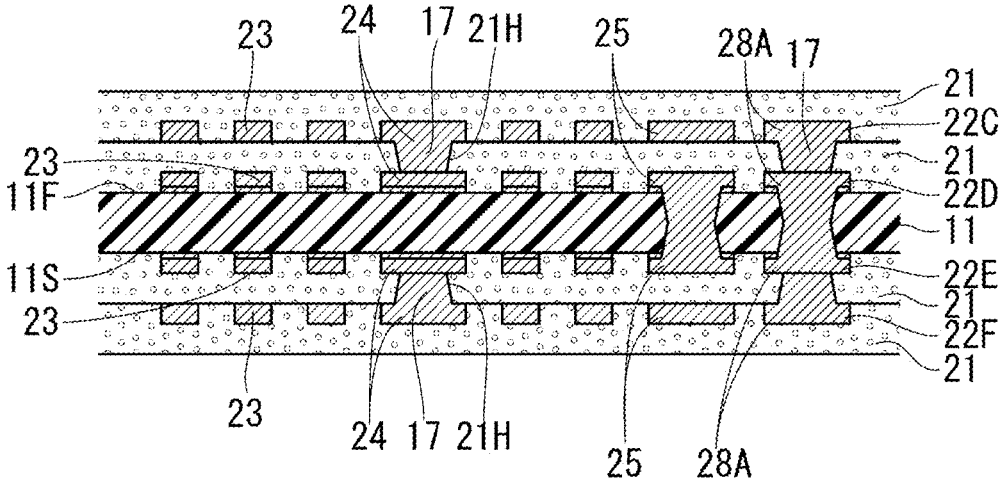
Figure 6C:
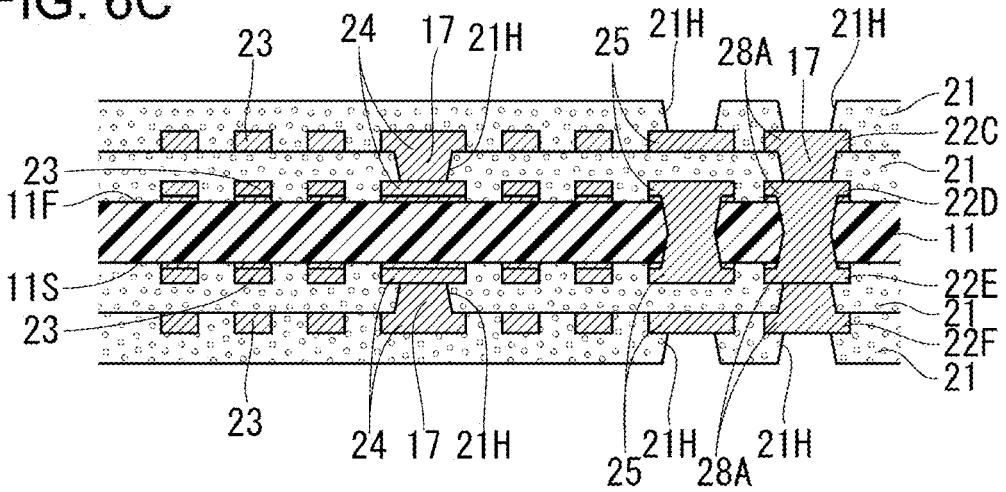
Figure 7A:
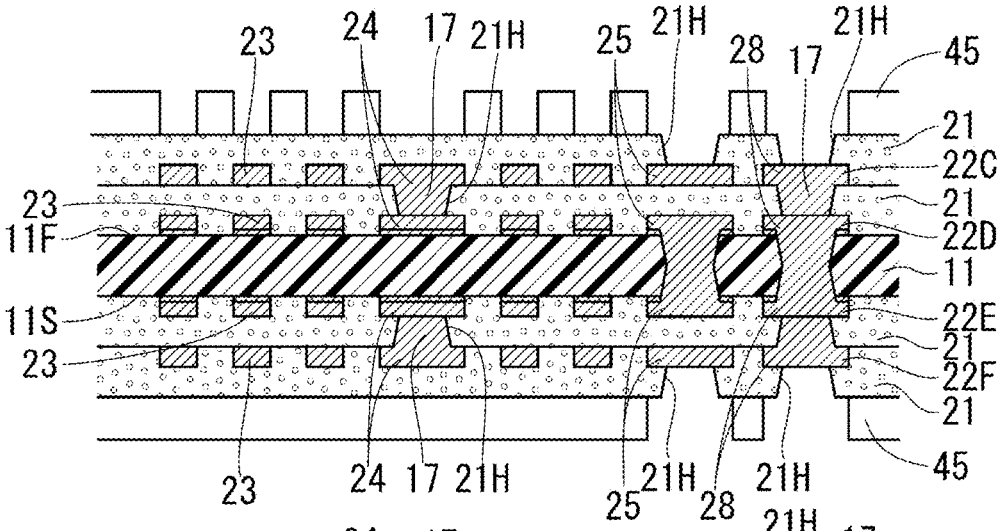
FIG. 7A-7C are cross-sectional side views illustrating manufacturing processes of the coil substrate.
Figure 7B:
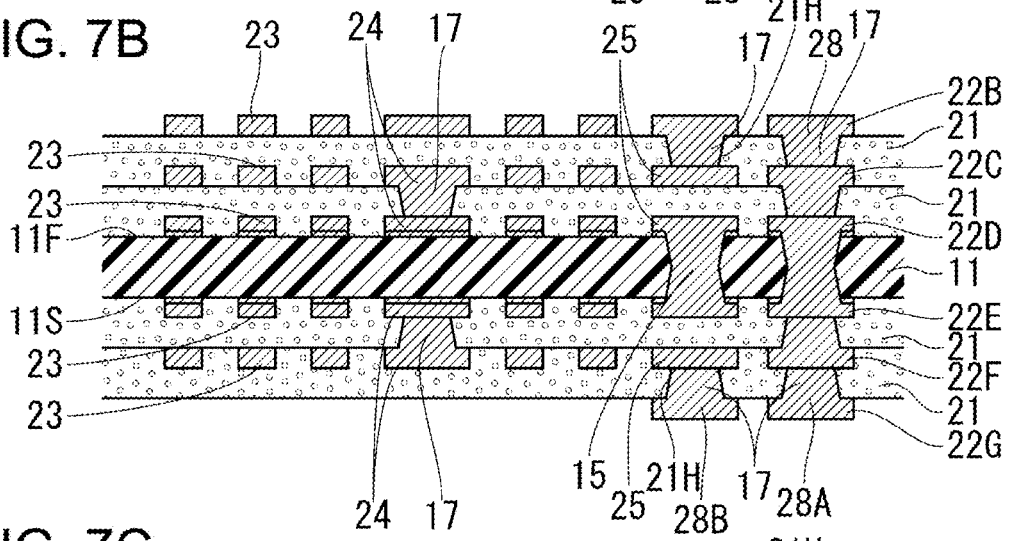
Figure 7C:
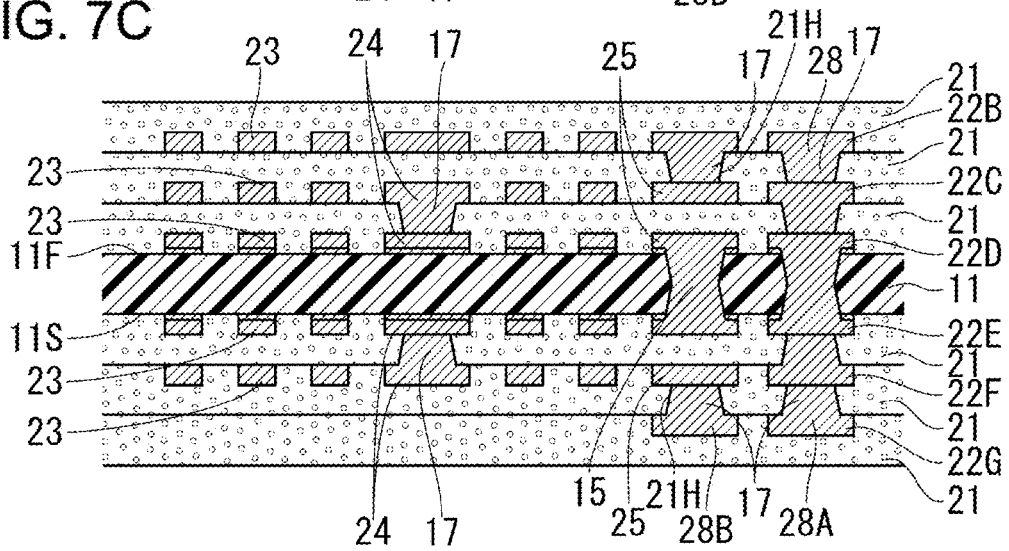

(9) An electrolytic plating treatment is performed. As illustrated in FIG. 6A, the via holes (21H) are filled with electrolytic plating and the via conductors 17 are formed; and electrolytic plating films (39, 39) are formed on portions of the electroless plating film (not illustrated in the drawings) on the interlayer insulating layers (21, 21), the portions being exposed from the plating resist 40.

(10) Next, the plating resist 40 is peeled off, and the electroless plating film (not illustrated in the drawings) below the plating resist 40 is removed. By the remaining electrolytic plating film 39 and electroless plating film, the third conductive layer (22C) is formed on the F surface (11F), and the sixth conductive layer (22F) is formed on the S surface (11S) side. Then, the third and fourth conductive layers (22C, 22D) are connected by the via conductors 17, and the fifth and sixth conductive layers (22E, 22F) are connected by the via conductors 17.

(11) Next, in the same way, as illustrated in FIGS. 6B, 6C, 7A, 7B, 7C and 8A in this order, on the F surface (11F) side of the core substrate 11, the interlayer insulating layer 21, the second conductive layer (22B), the interlayer insulating layer 21, and the first conductive layer (22A) are sequentially laminated, and, on the S surface (11S) side of the core substrate 11, the interlayer insulating layer 21, the seventh conductive layer (22G), the interlayer insulating layer 21, and the eighth conductive layer (2211) are sequentially laminated, and adjacent conductive layers (22, 22) are connected by the respective via conductors 17.

Figure 8A:
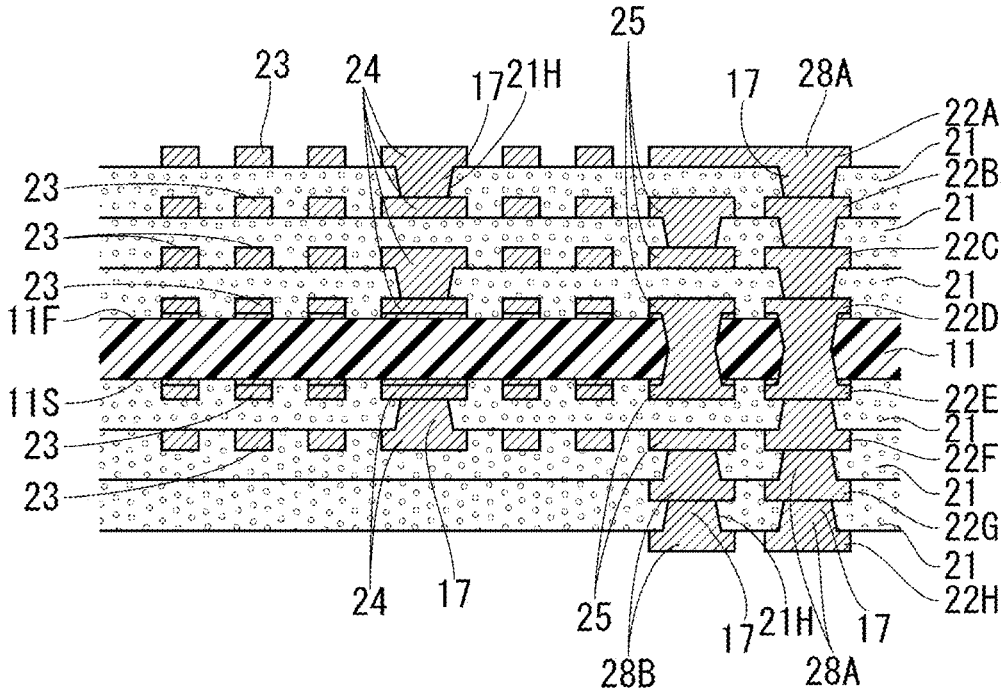
FIGS. 8A and 8B are cross-sectional side views illustrating manufacturing processes of the coil substrate.
Figure 8B:
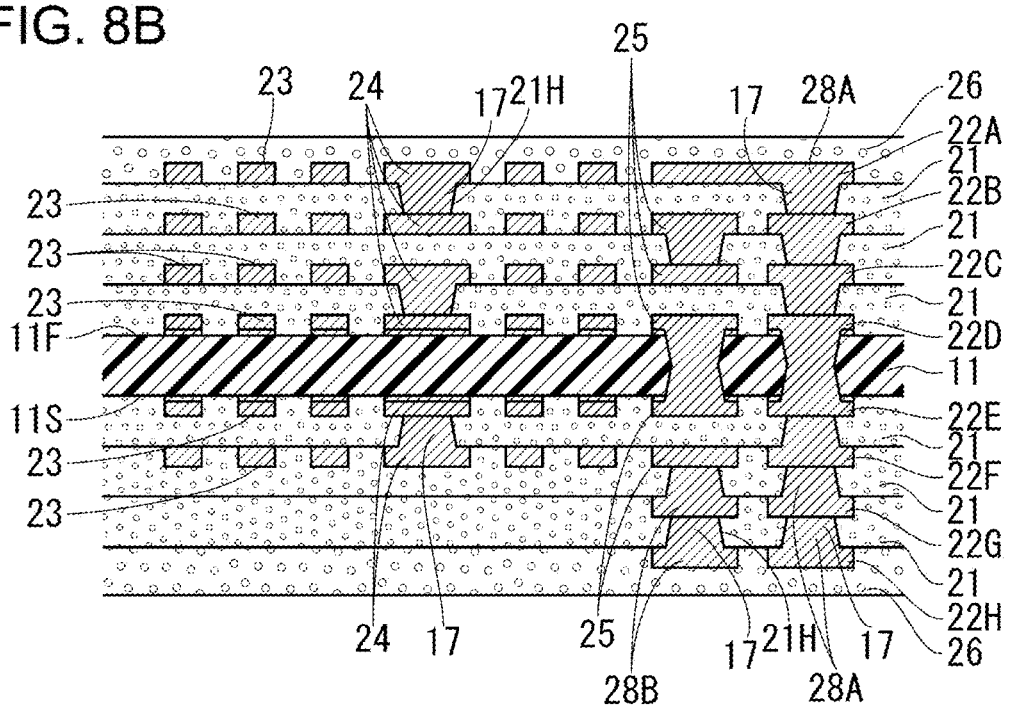

(12) Next, as illustrated in FIG. 8B, the solder resist layers (26, 26) are respectively laminated on the first and eighth conductive layers (22A, 22H).

(17) Then, the tapered openings (26A) are formed at predetermined places of the solder resist layer 26 on the S surface (11S), and a portion of the first land part (28A) and a portion of the second land part (28B) of the eighth conductive layer (22H) are exposed from the solder resist layer 26, and the pair of the pads (29, 29) are formed. As a result, the coil substrate 10 illustrated in FIG. 1 is completed.

The description about the structure and the manufacturing method of the coil substrate 10 of the present embodiment is as given above. Next, an operation effect of the coil substrate 10 is described. The coil substrate 10 of the present embodiment is applied, for example, as a coil element. Specifically, for example, the pair of the pads (29, 29) of the coil substrate 10 are formed opposing a pair of pads of a circuit board (not illustrated in the drawings) and are connected by solder balls provided on any ones of the pads. In this way, the coil substrate 10 can be applied as a coil element of a circuit on a circuit board.

Further, the coil substrate 10 can also be applied as a component of a sensor. As an example, a resistor is connected to the pair of the pads (29, 29) of the coil substrate 10, and the entire coil substrate 10 is fixed to a movable part of a home electric appliance or the like. A sensor main body having an electromagnetic coil (not illustrated in the drawings) is fixed to a supporting component that supports the movable part. Further, one end of the electromagnetic coil is formed opposing the first surface (10F) of the coil substrate 10. Then, a position or vibration of the movable part is detected based on a change in mutual inductance between the electromagnetic coil and the coil part 23, the mutual inductance varying according to the position of the movable part. That is, the coil substrate 10 can be applied as a component of a sensor.

Here, in the coil substrate 10 of the present embodiment, the conductive layers 22 containing the coil parts 23 are not sandwiched between conductive layers 22 that do not contain coil parts 23, and are formed closer to the first surface (10F) side of the coil substrate 10. As a result, it is unnecessary to provide an insulating layer having a high magnetic permeability that is required for a conventional coil substrate. That is, the coil substrate 10 of the present embodiment can have a simpler structure than a conventional coil substrate. Further, the core substrate 11 is provided in the center portion in the plate thickness direction of the coil substrate 10. Therefore, the coil substrate 10 has a higher strength than a conventional coil substrate, and is well balanced between the first surface (10F) side and the second surface (10S) side, and warpage is prevented. Further, since the conductive layers (22, 22) are laminated also in the core substrate 11 having a reinforcing effect, effective application of the core substrate 11 is achieved. Further, in the coil substrate 10, of a conductive layer 22 that does not have a coil part 23, a portion overlapping with the coil parts 23 in the plate thickness direction is a blank part (23K) where a conductor does not exist. Therefore, a decrease in a magnetic flux intensity of the coil parts 23 due to a conductive layer 22 that does not have a coil part 23 is suppressed.

Other Embodiments

The present invention is not limited to the above-described embodiment. For example, embodiments described below are also included in the technical scope of the present invention.

(1) In the coil substrate 10 of the above embodiment, the coil part 23 is provided at only place in the planar shape. However, it is also possible that the coil part 23 is provided at multiple places in the planar shape.

(2) In the coil substrate 10 of the above embodiment, the conductive layers 22 containing the coil parts 23 are not sandwiched between conductive layers 22 that do not contain coil parts 23 and are formed closer to the first surface (10F) side. However, it is also possible that the coil substrate 10 has a structure in which the conductive layers 22 containing the coil parts 23 are sandwiched between conductive layers 22 that do not contain coil parts 23.

(3) It is also possible that a dummy circuit that is not connected to the outer land part 25 is formed in the blank part (23K) of the conductive layer 22 that does not contain a coil part 23.

(4) In the coil substrate 10 of the above embodiment, winding directions of the spiral shapes of adjacent coil parts 23 are different from each other. However, it is also possible that the winding directions of the spiral shapes of adjacent coil parts 23 are the same.

(5) In the coil substrate 10 of the above embodiment, the shape of each of the lands is quadrangular. However, it is also possible that the shape of each of the lands is circular.

(6) In the coil substrate 10 of the above embodiment, the coil parts 23 each have a square spiral shape. However, it is also possible that the coil parts 23 each have a circular spiral shape.

In a coil substrate, in order to suppress a decrease in a magnetic force of a coil part, an insulating layer having a high magnetic permeability may be applied between the coil part and a surface of the coil substrate, and problems such as having a complicated structure are likely to occur.

A coil substrate according to an embodiment of the present invention has a simpler structure than a conventional coil substrate, and another embodiment of the present invention provides a method for manufacturing the coil substrate.

A coil substrate according to an embodiment of the present invention includes three or more conductive layers laminated via insulating layers. Spiral-shaped coil parts are respectively formed in some of the multiple conductive layers including an outermost conductive layer on one end side in a plate thickness direction of the coil substrate but not including an outermost conductive layer on the other end side in the plate thickness direction of the coil substrate. The coil parts are aligned in the plate thickness direction.

Obviously, numerous modifications and variations of the present invention are possible in light of the above teachings. It is therefore to be understood that within the scope of the appended claims, the invention may be practiced otherwise than as specifically described herein.

The invention claimed is:

1. A coil substrate, comprising:

a plurality of insulating layers; and a plurality of conductive layers laminated on the insulating layers in a plate thickness direction of the plurality of insulating layers, respectively such that the plurality of conductive layers includes a first outermost conductive layer on one end side in the plate thickness direction and a second outermost conductive layer on an opposite end side in the plate thickness direction, wherein the plurality of conductive layers comprises at least three conductive layers and includes a set of conductive layers such that the set of conductive layers includes the first outermost conductive layer and does not include the second outermost conductive layer, each of the conductive layers in the set has a coil portion formed such that the coil portion has a spiral form comprising an inner land portion at an inner end, an outer land portion at an outer end, and a middle linear portion between the inner land portion and the outer land portion and that the coil portion formed in a plurality is aligned one another in the plate thickness direction, and the second outermost conductive layer does not have a coil portion and is formed such that the second outermost conductive layer is positioned to not overlap with the middle linear portion of each of the coil portions in the set of conductive layers in the plate thickness direction.

2. A coil substrate according to claim 1, wherein the plurality of conductive layers is formed such that a plurality of portions overlapping with the coil portions in the plate thickness direction does not have conductors in the plate thickness direction.

3. A coil substrate according to claim 1, further comprising:

a plurality of interlayer connection conductors formed in the plurality of insulating layers such that the plurality of interlayer connection conductors is connecting the plurality of coil portions.

4. A coil substrate according to claim 1, wherein the plurality of conductive layers is formed such that conductive layers that do not have the coil portions are consisting of a plurality of land portions positioned to be connected to one of an electric element and an adjacent land conductive layer in the plurality of conductive layers.

5. A coil substrate according to claim 1, wherein the set of conductive layers is consisting of the coil portions and a plurality of land portions positioned to be connected to one of an electric element and an adjacent land conductive layer in the plurality of conductive layers.

6. A coil substrate according to claim 1, wherein the set of conductive layers is consisting of the coil portions, at least one relay portion, and a plurality of land portions positioned to be connected to one of an electric element and an adjacent land conductive layer in the plurality of conductive layers.

7. A coil substrate according to claim 1, wherein the plurality of conductive layers is formed such that the plurality of conductive layers does not have a conductive layer interposed between the set of conductive layers.

8. A coil substrate according to claim 7, wherein the plurality of insulating layers includes a core substrate, a plurality of first interlayer insulating layers formed on a first surface of the core substrate, and a plurality of second interlayer insulating layers formed on a second surface of the core substrate, and the plurality of conductive layers includes a plurality of first conductive layers formed on the first surface of the core substrate and first interlayer insulating layers, and a plurality of second conductive layers formed on the second surface of the core substrate and second interlayer insulating layers.

9. A coil substrate according to claim 1, wherein the plurality of insulating layers includes a core substrate, a plurality of first interlayer insulating layers formed on a first surface of the core substrate, and a plurality of second interlayer insulating layers formed on a second surface of the core substrate, and the plurality of conductive layers includes a plurality of first conductive layers formed on the first surface of the core substrate and first interlayer insulating layers, and a plurality of second conductive layers formed on the second surface of the core substrate and second interlayer insulating layers.

10. A coil substrate according to claim 9, wherein the plurality of first conductive layers and a group of the second conductive layers form the set of conductive layers including the plurality of coil portions respectively.

11. A coil substrate according to claim 9, wherein the plurality of first interlayer insulating layers and the plurality of second interlayer insulating layers have a same number of interlayer insulating layers.

12. A coil substrate according to claim 9, wherein the core substrate includes reinforcing fibers, and the first and second interlayer insulating layers do not contain reinforcing fibers.

13. A coil substrate according to claim 1, further comprising:

a plurality of first interlayer connection conductors formed in the plurality of insulating layers such that the plurality of first interlayer connection conductors is connecting the plurality of coil portions at inner ends of the plurality of coil portions; and a plurality of second interlayer connection conductors formed in the plurality of insulating layers such that the plurality of second interlayer connection conductors is connecting the plurality of coil portions at outer ends of the plurality of coil portions, wherein the first and second interlayer connection conductors are positioned alternately in the plurality of insulating layers in the plate thickness direction such that the plurality of coil portions are connected in a series connection.

14. A coil substrate according to claim 13, wherein the plurality of coil portions is formed such that adjacent coil portions have spiral forms having different winding directions.

15. A coil substrate according to claim 13, further comprising:

a pair of extended connection conductors foil ied such that one extended connection conductor is connected to one end of the plurality of coil portions and the other extended connection conductor is connected to an opposite end of the plurality of coil portions in the plate thickness direction and that the pair of extended connection conductors is connected to the second outermost conductive layer.

* * * * *